US007346939B2

(12) United States Patent
Perry

(10) Patent No.: US 7,346,939 B2
(45) Date of Patent: Mar. 25, 2008

(54) TRIPLE SLIDE FRAMELESS SHOWER DOOR

(75) Inventor: Edward A. Perry, Long Beach, CA (US)

(73) Assignee: American Shower Door Corporation, City of Commerce, CA (US)

( * ) Notice: Subject to any disclaimer, the term of this patent is extended or adjusted under 35 U.S.C. 154(b) by 1041 days.

(21) Appl. No.: 10/385,207

(22) Filed: Mar. 10, 2003

(65) Prior Publication Data

US 2004/0177437 A1 Sep. 16, 2004

(51) Int. Cl.
*A47K 3/08* (2006.01)
*A47K 3/14* (2006.01)
*E05D 15/16* (2006.01)

(52) U.S. Cl. ..... 4/557; 4/607; 49/406; 49/410; 49/411; 49/456

(58) Field of Classification Search ..... 4/557, 4/607; 49/406–409, 410–412, 456, 457, 49/471; 52/207
See application file for complete search history.

(56) References Cited

U.S. PATENT DOCUMENTS 2,783,860 A * 3/1957 Taubman ..... 4/607
3,111,208 A * 11/1963 Grossman ..... 4/607
3,359,573 A * 12/1967 Casebolt ..... 4/607
3,461,466 A 8/1969 Weaver et al.
3,796,405 A * 3/1974 Rystad ..... 248/489
3,805,450 A 4/1974 Forcina
3,896,508 A 7/1975 Doan
4,073,035 A 2/1978 Baus
4,178,718 A 12/1979 Laby
4,258,443 A 3/1981 Baus
4,358,863 A 11/1982 Jacobsen
4,445,239 A 5/1984 Jacobsen
4,453,346 A * 6/1984 Powell et al. ..... 49/411
4,458,449 A 7/1984 Breuer
4,769,949 A 9/1988 Glendowne
4,785,485 A 11/1988 Etesam
4,868,935 A 9/1989 Van Weelden
5,450,693 A * 9/1995 Tarrega ..... 49/411
5,469,666 A * 11/1995 Lewis, Jr. ..... 49/471
5,598,666 A 2/1997 Kurth
5,893,181 A 4/1999 Moncaster
6,371,188 B1 * 4/2002 Baczuk et al. ..... 49/471
6,381,904 B1 * 5/2002 Tedescucci ..... 49/409

* cited by examiner

*Primary Examiner*—Tuan Nguyen
(74) *Attorney, Agent, or Firm*—Christie, Parker & Hale, LLP.

(57) ABSTRACT

A sliding door assembly includes at least three frameless panels that are slidably installed to form a door to an enclosed tub or shower area. Each frameless panel is gripped at a top by at least two roller assemblies, and the roller assemblies are slidably suspended from a header that supports the frameless panels via the roller assemblies. The sliding door assembly also includes a guide assembly that has at least three tracks, wherein each frameless panel is guided by a corresponding one of the tracks.

19 Claims, 12 Drawing Sheets

TRIPLE SLIDE FRAMELESS SHOWER DOOR

BACKGROUND

The present invention relates generally to sliding door panels for enclosures and more particularly to door panels for tub and shower enclosures.

Most conventional tub and shower door panels of the sliding type are of tempered glass for a water barrier, light transmission and cleansing ease. Because of their fragile nature, they are usually framed using aluminum or other non-corrosive metals. These frames are undesirable from an aesthetic point of view. Hence, aesthetic quality of a tub/shower door may be enhanced if a method and apparatus can be devised to eliminate door frames, especially when more than two panels are used so as to increase the width of an entrance when the door panels are in a fully opened position.

Therefore, it is desirable to provide a method and apparatus for a sliding door assembly having at least three frameless door panels.

SUMMARY

An exemplary embodiment in accordance with aspects of the present invention provides a sliding door assembly for an enclosed tub or shower, said assembly comprising: at least three frameless panels; a plurality of roller assemblies, wherein each frameless panel is gripped at a top by at least two roller assemblies; a header supporting the frameless panels via the roller assemblies, wherein the roller assemblies are slidably suspended from the header; and a guide assembly having at least three tracks, wherein each frameless panel is guided by a corresponding one of the tracks.

This and other aspects of the invention will be more readily comprehended in view of the discussion herein and accompanying drawings, in which like reference numerals designate like elements.

DETAILED DESCRIPTION

Figure 1:
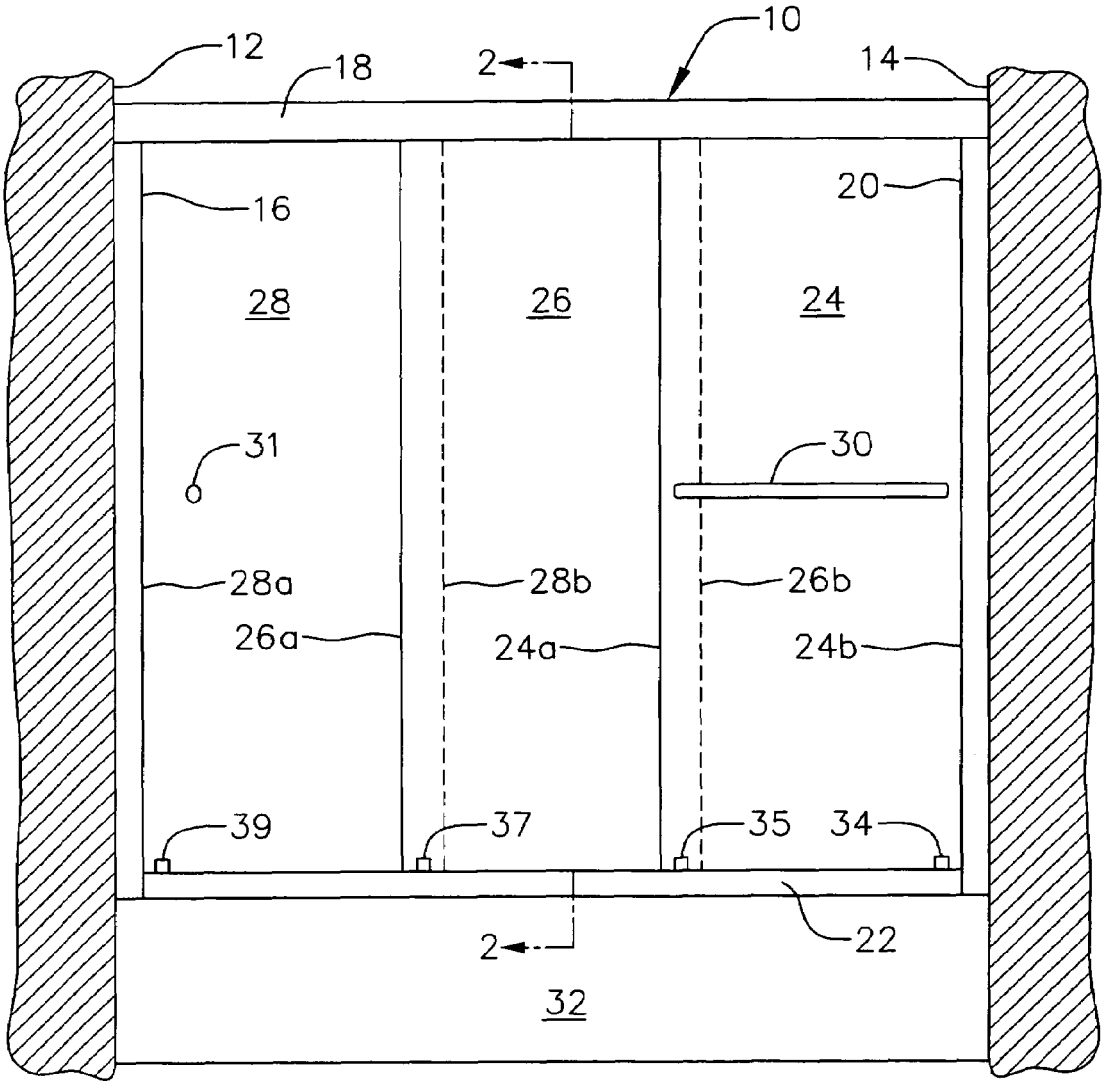
FIG. 1 is a front view of a sliding door assembly in an exemplary embodiment in accordance with aspects of the present invention.

FIG. 1 is a sliding door assembly 10 installed between vertical uprights 12 and 14 in an exemplary embodiment in accordance with aspects of the present invention. The vertical uprights 12 and 14 may, for example, define an entrance to an enclosed bathtub or shower area, which may be completely enclosed except for the entrance defined by the vertical uprights. The sliding door assembly 10 may be installed on a bathtub 32 as illustrated in FIG. 1. In other embodiments, of course, the sliding door assembly may be installed on the floor to define an entrance to a tub-less shower area. A shower head, for example, may be installed on the vertical upright 12 on the side facing the vertical upright 14.

The sliding door assembly 10 includes door panels (or panels) 24, 26 and 28 installed between wall jamb assemblies 16 and 20 that are mounted on vertical uprights 12 and 14, respectively. The door panels in the exemplary embodiment are frameless, and are slidably supported by a header 18, and are guided by a guide assembly 22 during opening and closing. In the exemplary embodiment, the door panels 24, 26 and 28 are suspended from the header 18. In other embodiments, the door panels may be supported at bottom by the guide assembly 22. In still other embodiments, the door panels may be supported by both the header 18 and the guide assembly 22.

Each of the door panels 24, 26 and 28 is substantially rectangular in shape. When looking in from outside the tub/shower area, the door panel 24 has left and right edges 24*a* and 24*b*, the door panel 26 has left and right edges 26*a* and 26*b*, and the door panel 28 has left and right edges 28*a* and 28*b*. The door panel 24 may be referred to as an outside panel (or an outer panel) because it is the outer most of the three panels with respect to a person inside a tub or shower area. In addition, the door panel 28 may be referred to as an inside panel (or an inner panel) since it is the inner most. Further, the door panel 26 may be referred to as a middle panel because it is between the door panels 24 and 28.

The door panel 24 has installed thereon a towel bar 30 for hanging a towel, for example. The towel bar 30 may also be used to open or close a tub/shower door that includes the door panels 24, 26 and 28 from outside of the enclosed tub or shower area. The towel bar 30 in the exemplary embodiment may have an elongated U shape as illustrated on FIG. 6A, and may be mounted on the door panel 24 through two holes formed on the door panel using a threadall 150 and a fastener 152, which may be threaded bolts or screws, for example. On the other side of the threadall 150 may be a knob 151 used to slide the door open from inside the enclosed tub or shower area. In other embodiments, the threadall 150 may be replaced by a screw, and the knob 151 may not be used. Of course, the towel bar 30 may have other shapes and/or installing methods in other embodiments.

Figure 6B:
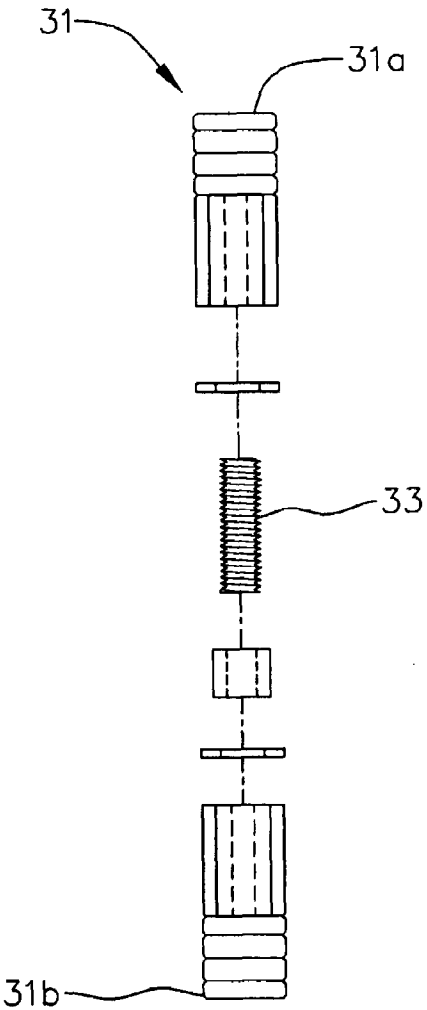
FIG. 6B is a knob assembly of the sliding door assembly of FIG. 1.
Figure 6A:
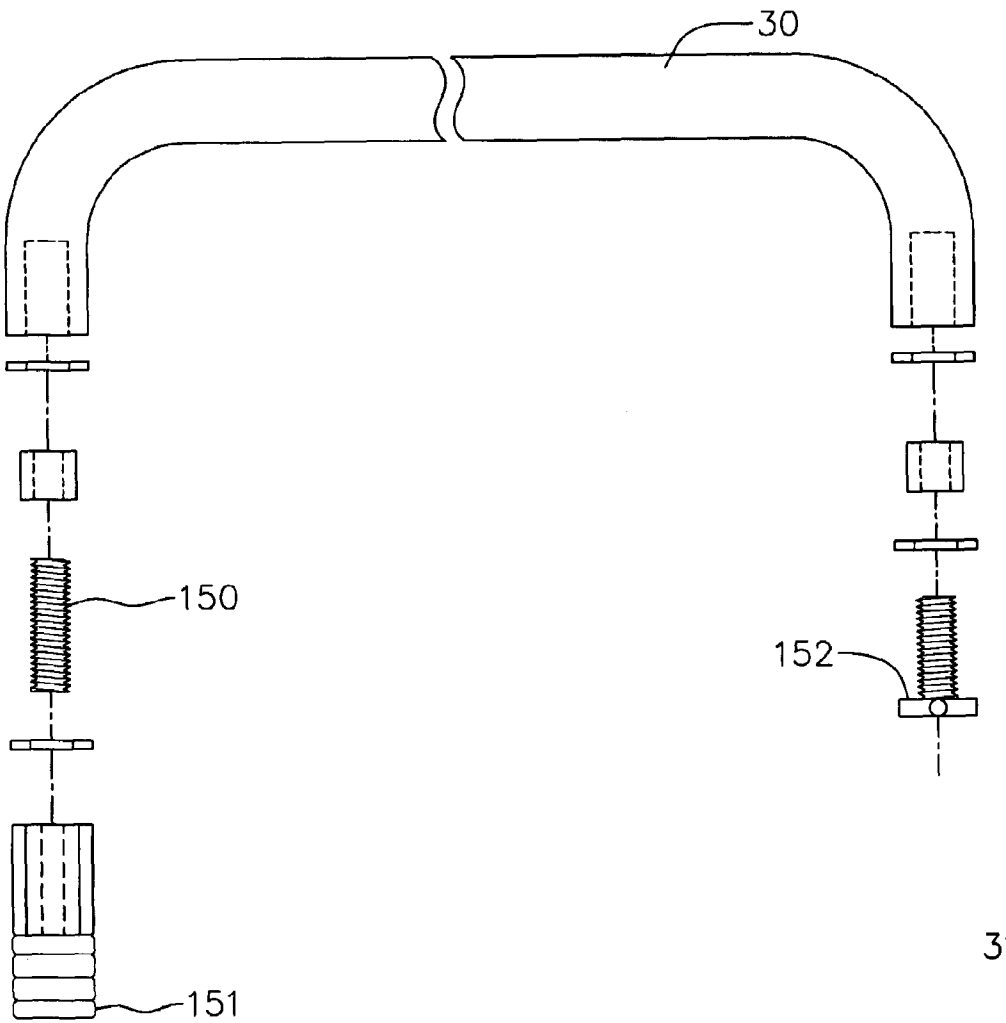
FIG. 6A is a towel bar of the sliding door assembly of FIG. 1.

The door panel 28 has installed thereon a knob assembly 31 near the left edge 28*a* for opening the tub/shower door from inside or outside of the enclosed tub or shower area. As illustrated in FIG. 6B, the knob assembly 31 in the exemplary embodiment includes knobs 31*a* and 31*b* mounted, respectively, on inside and outside surfaces of the door panel 28. As illustrated on FIG. 6B, the knobs 31*a* and 31*b* may be joined together using a threadall 33. Each of the knobs has a substantially cylindrical shape, and may have a threaded bore at center for receiving the threadall 33. In other embodiments, of course, the knobs 31*a* and 31*b* may have other shapes and/or installing methods.

The door panel 24 has bottom clips 34 and 35 that slidably fit inside the guide assembly 22 so that they prevent the door panel 24 from swinging with respect to a vertical plane while sliding the door panel 24 to open or close the tub/shower door. Similarly, the door panels 26 and 28 have bottom clips 37 and 39, respectively, for guiding them while opening and closing the tub/shower door. The door panel 26 has one other bottom clip that is behind the bottom clip 35, and the door panel 28 has one other bottom clip that is behind the bottom clip 37 (e.g., as shown on FIG. 3A). In other embodiments, the door panels may have different number of bottom clips, and the number of bottom clips on the door panels may be different between the door panels. The door panels 24 and 26 may also have push pull clips (e.g., as shown on FIG. 3A) installed on the other side of the bottom clips 35 and 37, respectively, so that the door panels 24, 26 and 28 can be opened or closed together using a single handle, for example, the towel bar 30 or the knob assembly 31.

Figure 2:
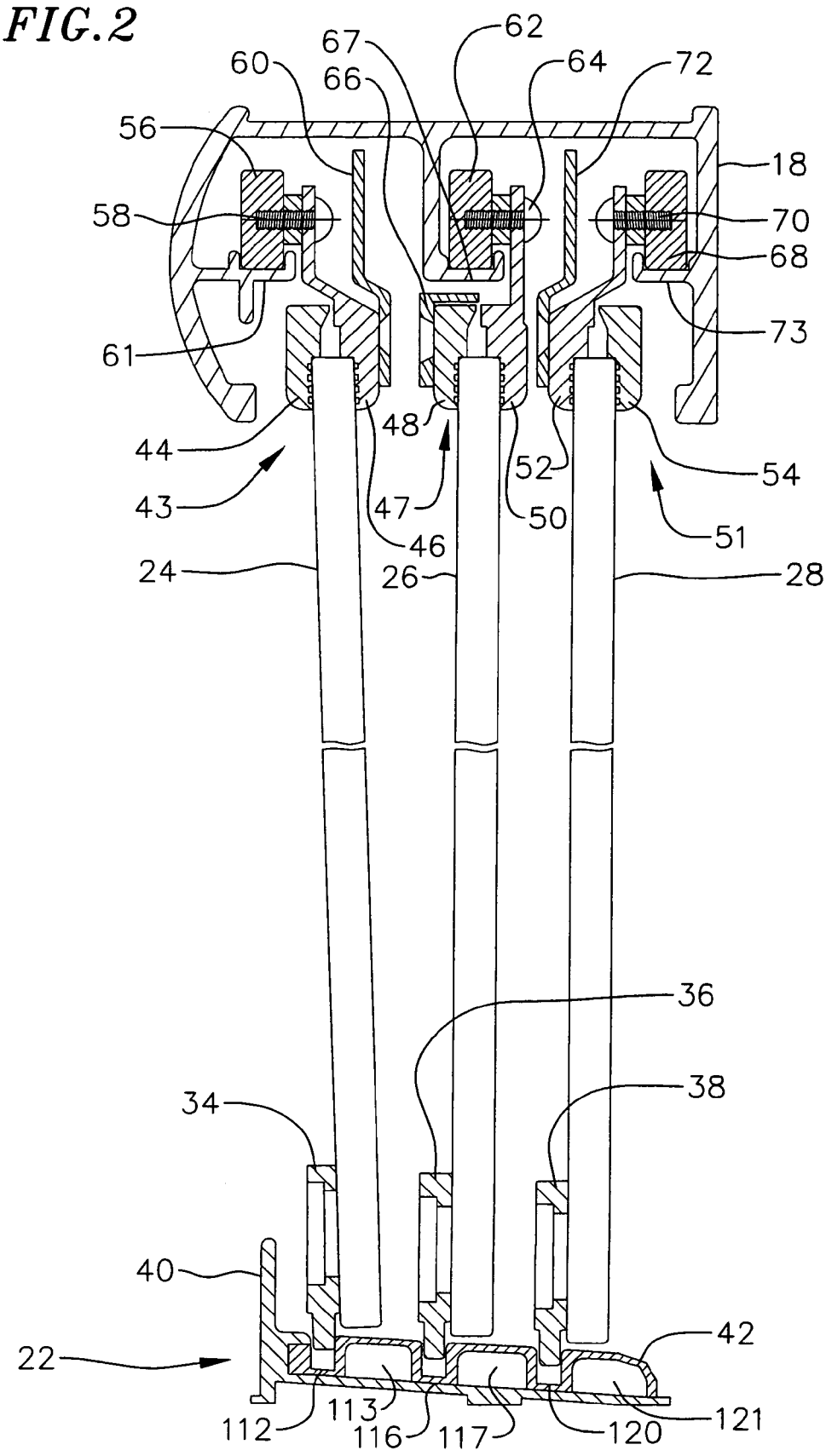
FIG. 2 is a sectional view of the sliding door assembly of FIG. 1 taken along line 2-2.

FIG. 2 is a sectional view of the sliding door assembly 10 of FIG. 1 taken along line 2-2 in an exemplary embodiment in accordance with aspects of the present invention. As shown in FIG. 1, the header 18 and the guide assembly 22, respectively, have a length that is substantially equal to the distance between the vertical uprights 12 and 14, and between the wall jamb assemblies 16 and 20, and the sectional view may be considered as just a cross section thereof. Each of the door panels 24, 26 and 28 appears as two shortened segments on FIG. 2; however, each of the illustrated segment pairs represents the corresponding door panel formed as a single integrated piece. The door panels 24, 26 and 28, for example may be formed from tempered glass of about 0.63 cm in thickness, and are frameless as described above. In other embodiments, the door panels may have other thickness and may be formed from other suitable materials such as other clear materials or acrylic.

Figure 7:
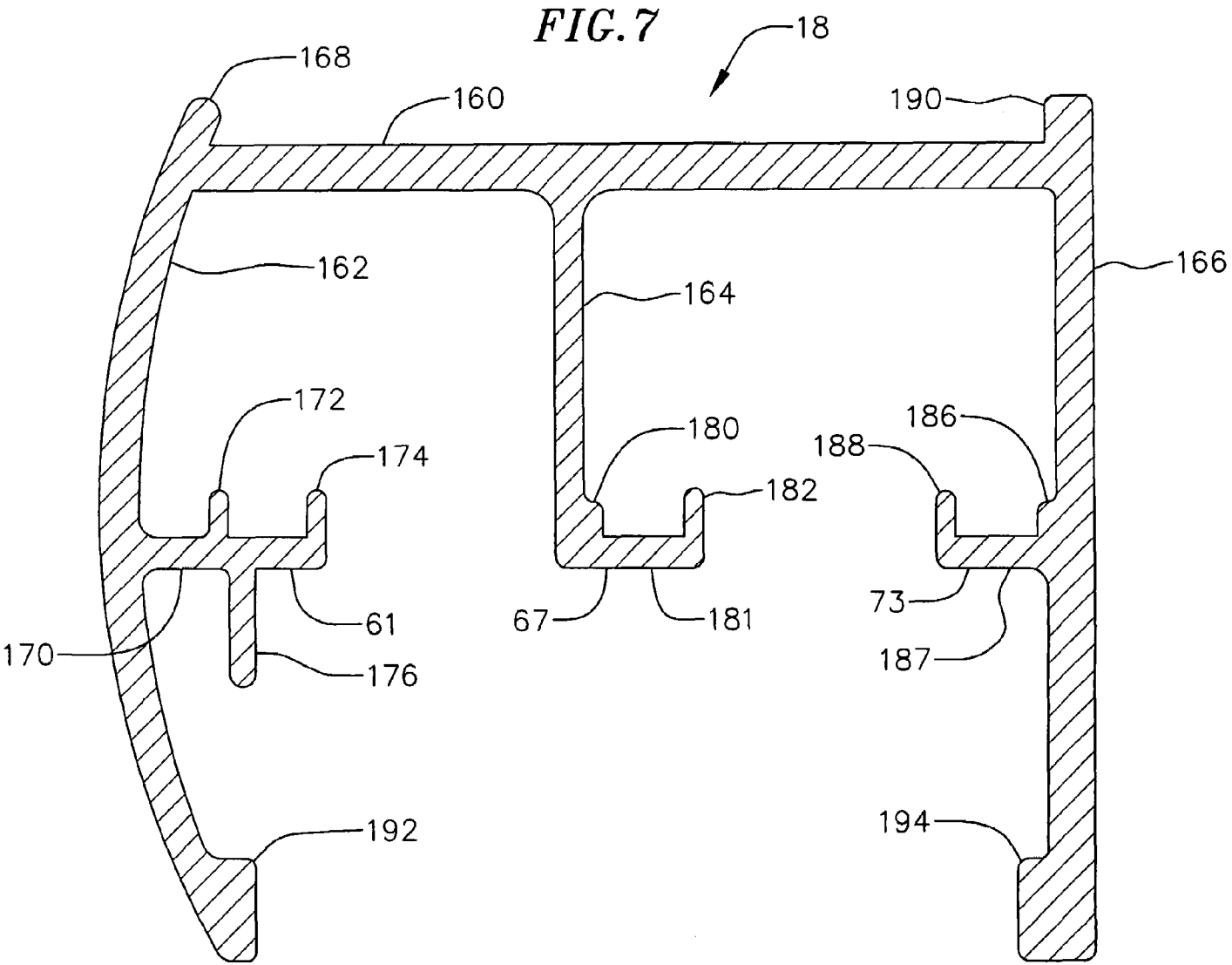
FIG. 7 is a cross-sectional view of the header of the sliding door assembly of FIGS. 1 and 2.

FIG. 7 is a cross-sectional view of the header 18 of the sliding door assembly of FIGS. 1 and 2. The header 18, of course, has a length that runs between the vertical uprights 12 and 14, and has a general appearance of an inverted W. The header 18 includes a top web 160 that has a generally horizontal cross-section, and flanges 162, 164 and 166 that have a generally vertical cross-section. The flanges 162, 164 and 166 run substantially through the length of the header 18, and extend from the top web in a generally downward direction. The top web 160 may also be referred to as a top bar or a top beam. The flanges 162, 164 and 166 may also be referred to as side bars. In the exemplary embodiment, the top web 160 and the flanges 162, 164 and 166 form as a single integrated piece.

The flange 162 is attached at the outer most end of the top web 160 from the enclosed area, the flange 166 is attached at the inner most end of the top web 160, and the flange 164 is located little less than half way between the flange 162 and the flange 166. The cross-section of the flange 162 is convex with respect to the vertical plane when viewed from outside the enclosed tub or shower area, and has a lip 168 that protrudes over the top web 160. The flange 162 has formed thereon a horizontal bar 170 that has a generally horizontal cross section and runs substantially along the length of the header 18.

The horizontal bar 170 has formed thereon two lips 172 and 174 whose cross-sections extend in an upward direction from the cross-section of the horizontal bar 170, and define a channel (or a track) 61. The lip 174, for example, is located at the end of the horizontal bar 170 away from the end attached to the flange 162, and the lip 172 is located little less than half way between the flange 162 and the lip 174. The horizontal bar 170 also has formed thereon a vertical bar 176 whose cross-section extends downward from the cross-section of the horizontal bar 170, and runs substantially along the length of the header 18. The vertical bar is located little more than half way between the flange 162 and the lip 174. The flange 162 also has at its lower edge a thickened portion 192 used to mount the header 18 on the wall jamb assemblies 16 and 20.

The flange 164 has formed thereon a channel (or a track) 67 that is at substantially the same vertical height as the channel 61. The channel 67 is formed on a bar 181 formed at the end of the flange 164 and having a generally horizontal cross section. The channel 67 is defined by a step 180 and a lip 182. The step 180 is located on the bar 181 adjacent to the flange 164, and is used to prevent a roller tire on the channel 67 from touching the flange 164. The lip 182 is formed at the end of the bar 181 and has a generally vertical cross-section that extends upward from the cross-section of the bar 181.

The flange 166 has formed around its half way point between top and bottom a bar 187 that substantially runs the length of the header 18. The bar 187 has formed thereon a channel 73 that is at substantially the same vertical height as the channels 61 and 67. The channel 73 is defined by a step 186 and a lip 188. The step 186 is located on the bar 187 adjacent to the flange 166. The lip 188 is located at the end of the bar 187 away from the flange 166. The lip 188 has a generally vertical cross-section that extends upward from the cross-section of the bar 187. The flange 166 has a portion 190 that extends slightly upward of the top web 160. The flange 166 has at its lower edge a thickened portion 194 for mounting the header 18 on the wall jamb assemblies 16 and 20.

Returning now to FIG. 2, the door panels 24, 26 and 28 are supported from the top by the header 18 through hanger assemblies 43, 47 and 51, respectively. Even though only one hanger assembly is illustrated as supporting each door panel, in practice, two or more hanger assemblies are used to support each door panel. In the exemplary embodiment, one or more other hanger assemblies that support each door panel is substantially identical to the hanger assembly for the corresponding door panel illustrated in FIG. 2. Hence, only the hanger assemblies 43, 47 and 51 will be described below, with the understanding that one or more other hanger assemblies that support each door are substantially identical to the hanger assemblies 43, 47 and 51, respectively. The configuration of different hanger assemblies on the same door panel may be different in other embodiments.

The hanger assemblies 43, 47 and 51 may be referred to as an outer hanger assembly, middle hanger assembly and an inner hanger assembly, respectively. The outer hanger assembly 43 includes an outer small hanger 44 and an outer large hanger 46 that grip the door panel 24, the middle hanger assembly 47 includes a middle small hanger 48 and a middle large hanger 50 that grip the door panel 26, and the inner hanger assembly 51 includes an inner large hanger 52 and an inner small hanger 54 that grip the door panel 28. Each pair of small and large hangers clamps onto the corresponding door panel so as to hold it up in a suspended position. For such clamping, each pair of the small and large hangers are attached together via a bolt or a screw.

The hanger assembly 43 is connected to a center rim of a roller tire 56 via a fastener 58. The hanger assembly 47 is connected to a center rim of a roller tire 62 via a fastener 64. The hanger assembly 51 is connected to a center rim of a roller tire 68 via a fastener 70. Each of the fasteners 58, 64 and 70, for example, may be a bolt or screw. Each hanger assembly and roller tire together may be referred to as a roller assembly. It should be noted that the hanger assemblies 43, 47, 51 and the roller tires 56, 62 and 68 are provided only for illustrative purposes. Each door panel in practice are suspended from the header 18 by two or more of such hanger assembly and roller tire combination (i.e., two or more roller assemblies) or other hanger assemblies known in the art.

The roller tires 56, 62 and 68 are slidably (or rollably) supported, respectively, by the channel 61, the channel 67, and the channel 73 of the header 18. The lip 172 prevents the roller tire 56 from touching the flange 162, the step 180 prevents the roller tire 62 from touching the flange 164, and the step 186 prevents the roller tire 68 from touching the flange 166.

Figure 8:
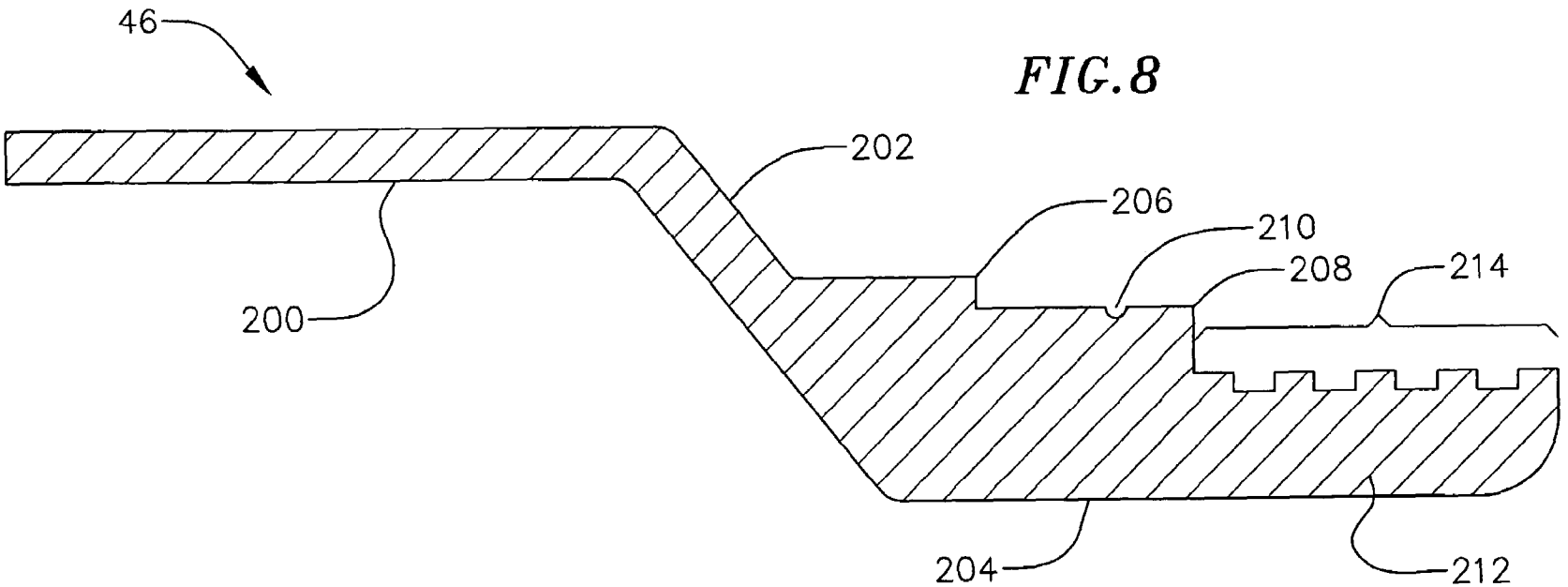
FIG. 8 is an outer large hanger of an outer hanger assembly illustrated on FIG. 2.

The outer and inner large hangers 46 and 52 are configured substantially the same as one another, and the description will be made below for the outer large hanger 46 only, with the understanding that the description applies equally well to the inner large hanger 52. As illustrated in FIG. 8, the outer large hanger 46 includes an elongated portion (or a pan handle portion) 200 that is attached to the roller tire 56 via the fastener 58. The outer large hanger 46 also includes a gripper 204 that is connected to the elongated portion 200 via a bridge 202. The bridge 202 is attached to the elongated portion 200 and the gripper 204 at an angle, and the elongated portion, the bridge and the gripper are formed as a single integrated piece.

The gripper 204 includes a step 206 and a step 208. The step 208 has formed thereon a notch 210. The steps 206 and 208 lead from the joint between the bridge 202 and the gripper 204 to a gripping member 212 that has formed thereon a plurality of teeth 214 for gripping the door panel 24 on one side. In the exemplary embodiment, the gripping member 212 has four teeth 214. In other embodiments, the gripping member may have more or less than four teeth.

The door panel 24 is gripped on the other side by an outer small hanger 44 that has teeth that are substantially the same as the teeth 214 of the outer large hanger 46. As shown in FIG. 2, the outer small hanger 44 does not have an elongated portion such as the elongated portion 200 of the outer large hanger 46. The inner and middle small hangers 54 and 48 are substantially identical to the outer small hanger 44.

Figure 9:
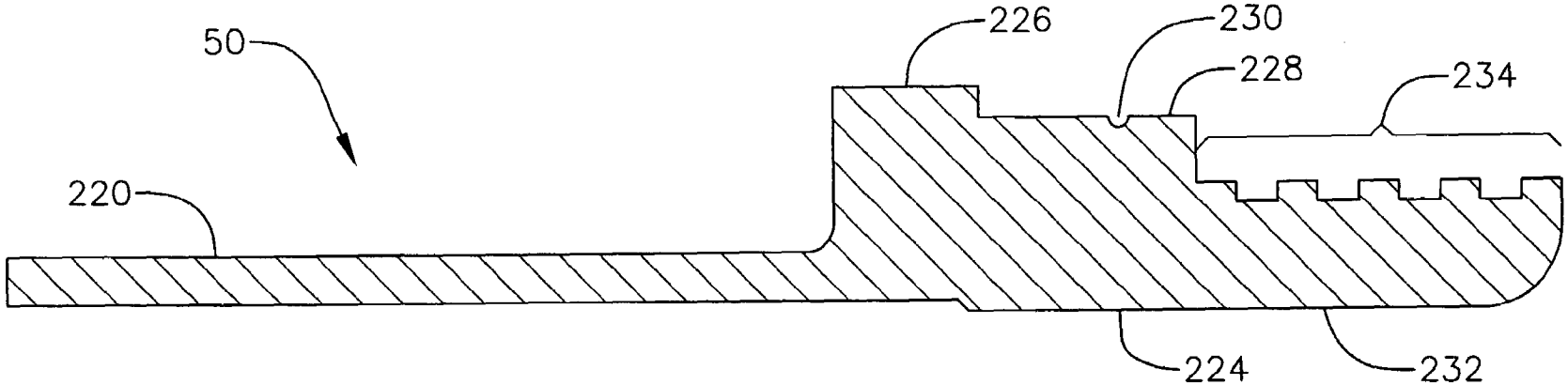
FIG. 9 is an inner large hanger of an inner hanger assembly illustrated on FIG. 2.

As illustrated in FIG. 9, the middle large hanger 50 includes an elongated portion (or a pan handle portion) 220 that are attached to the roller tire 62 via the fastener 64. The middle large hanger 50 also includes a gripper 224 that is connected to the elongated portion 220. The gripper 224 includes a step 226 and a step 228. The step 228 has formed thereon a notch 230. The step 226 steps up from the joint between the elongated portion and the gripper 224, and the step 228 steps down from the step 226. Attached to the step 228 is a gripping member 232 that has formed thereon a plurality of teeth 234 for gripping the door panel 26 on one side. In the exemplary embodiment, the gripping member 232 has four teeth 234. In other embodiments, the gripping member may have more or less than four teeth. The door panel 26 is gripped on the other side by the middle small hanger 48.

Returning now to FIG. 2, in order to keep the roller tire 56 from de-tracking (i.e., skipping out of the channel 61), an outer anti skip bracket 60 is attached to the outer hanger assembly 43 after the roller tire 56 is installed on the outer track 61. Further, the outer anti skip bracket 72 is installed on the outer hanger assembly 51 after the roller tire 68 is mounted on the inner track 73 in order to keep the roller tire 68 from de-tracking. The anti skip brackets 60 and 72 are substantially identical to one another, and only the anti skip bracket 60 will be described below.

Figures 10, 11:
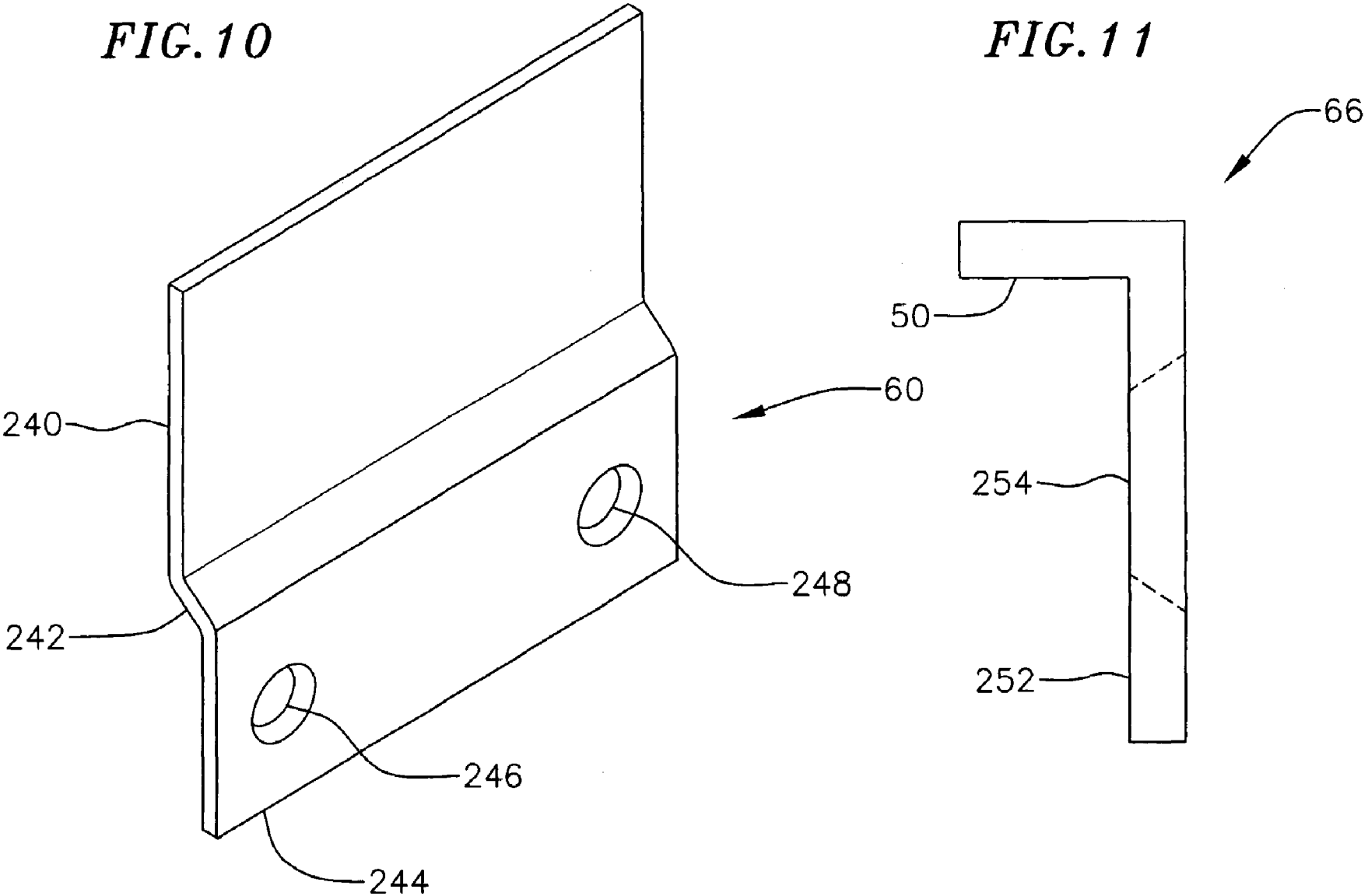
FIG. 10 is an outer anti skip (or anti jump) bracket illustrated on FIG. 2.
FIG. 11 is an inner anti skip (or anti jump) bracket illustrated on FIG. 2.

FIG. 10 illustrates the outer anti skip bracket 60 in an exemplary embodiment, which has a substantially rectangular portion 240 connected to a substantially rectangular portion 244 via a bridge 242. The anti skip bracket 60, for example, may be a single piece of clear polycarbonate. The anti skip brackets may be made of other suitable materials in other embodiments. The bridge 242, which may also be referred to as a connecting member, forms an angle with respect to the substantially rectangular portions 240 and 244. The substantially rectangular portion 244 has two holes 246 and 248 formed thereon for attaching the outer anti skip bracket 60 to the outer large hanger 46. Each of the holes 246 and 248 has a circular opening that is larger on one side than the other with a gradually decreasing diameter therebetween, and may be used, for example, to counter sink a screw. The substantially rectangular piece 240 prevents the roller tire 56 from skipping out of the channel 61 by physically limiting the roller tire's vertical movement.

Similarly, as illustrated in FIG. 2, a middle anti skip bracket 66 is attached to the middle hanger assembly 48 to keep the roller tire 62 from de-tracking. The middle anti skip bracket 66, for example, is illustrated in FIG. 11. The middle anti skip bracket 66 includes a substantially rectangular portion 250 attached to another substantially rectangular portion 252 at a substantially 90 degree angle. The anti skip bracket 66, for example, may be a single piece of aluminum. The anti skip brackets in other embodiments may be made of other suitable materials. The substantially rectangular piece 252 has formed thereon a hole 254, whose circular opening is greater on one side than the other with a gradually decreasing diameter therebetween, and may be used to counter sink a screw. The substantially rectangular piece 250 prevents the roller tire 62 from skipping out of the track 67 by physically limiting the vertical upward movement of the hanger assembly 47 as illustrated in FIG. 2. The anti skip brackets 60, 66 and 72 may also be referred to as anti jump brackets.

Returning now to FIG. 2, bottom clips 34, 36 and 38 are attached to the door panels 24, 26 and 28, respectively. The bottom clips 34, 36 and 38 are slidably placed in bottom tracks (or grooves) 112, 116 and 120, respectively, of the guide assembly 22.

Figure 4:
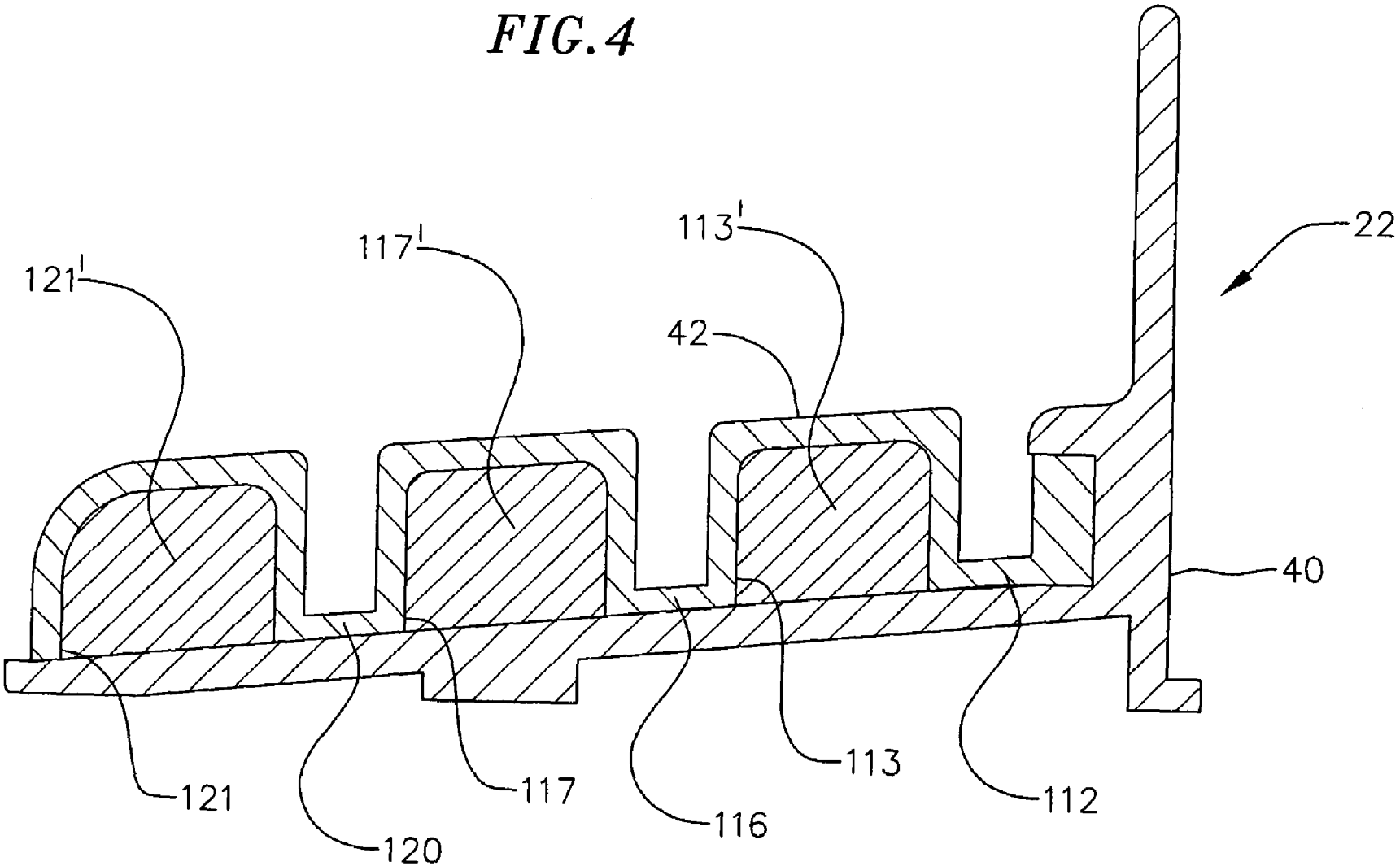
FIG. 4 is a cross-sectional view of a guide assembly of the sliding door assembly of FIG. 1.

FIG. 4 is a cross-sectional view of the guide assembly 22. The guide assembly 22 may be formed from at least two components, namely, a bottom sill 40, a side view (i.e., a cross-section) of which is illustrated on FIG. 5A and a bottom guide 42, a side view (i.e., a cross-section) of which is illustrated on FIG. 5B. In the exemplary embodiment, the bottom guide 42 is shorter than the bottom sill 40 at both ends so that any moisture (e.g., water) accumulating in the tracks 112, 116 and/or 120 may easily be drained. For example, the bottom guide 42 may be shorter than the bottom sill 40 by approximately 1.27 cm to 2.54 cm at each end. Further, the bottom guide 42 and the bottom sill 40, when assembled, have openings 113, 117 and 121. These openings in the exemplary embodiment are plugged using plugs 113', 117' and 121', respectively, so as to prevent moisture from entering therein.

Figures 5A, 5B:
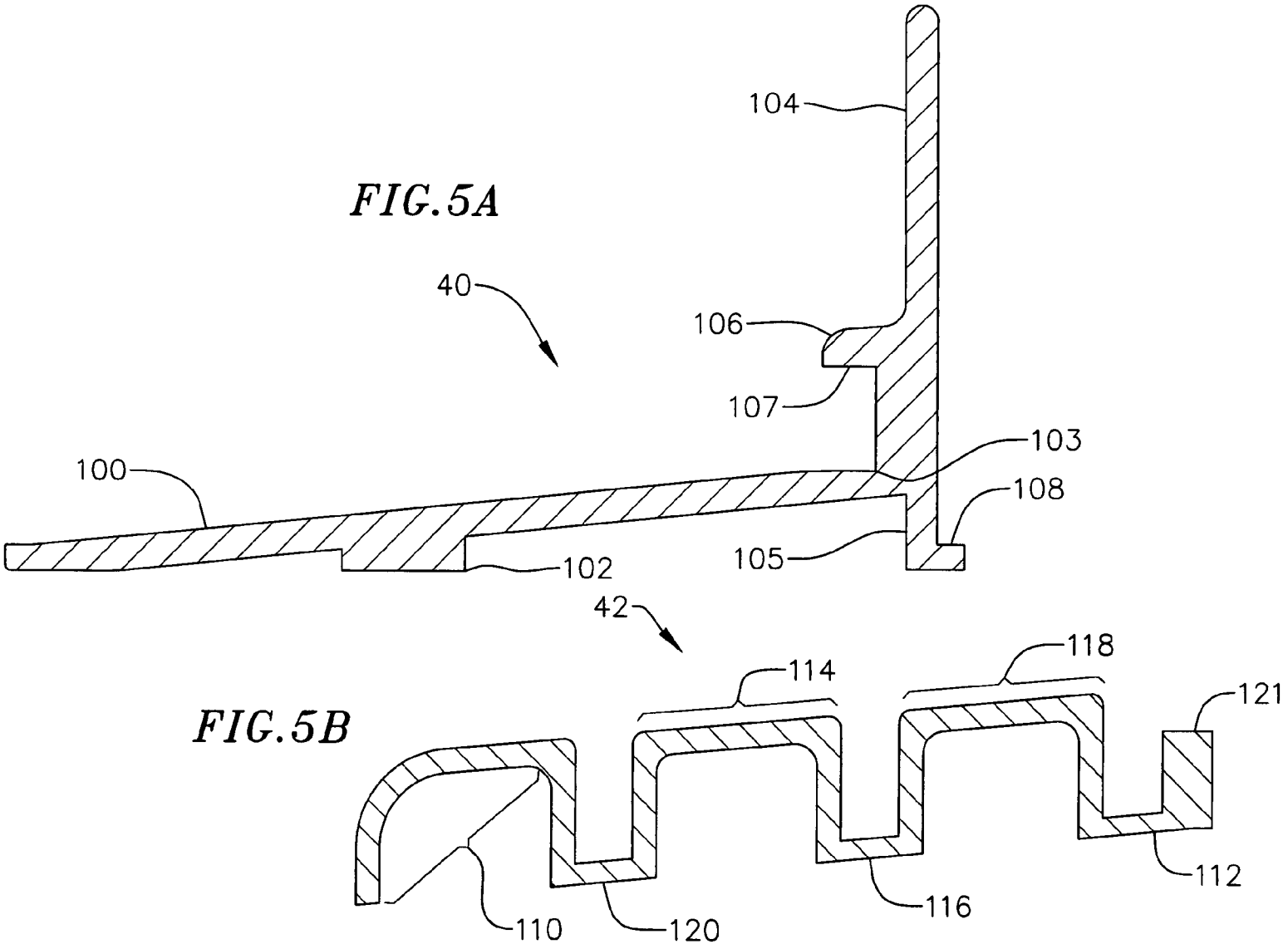
FIG. 5A is a cross-sectional view of a bottom sill of the guide assembly of FIG. 4.
FIG. 5B is a cross-sectional view of a bottom guide of the guide assembly of FIG. 4.

The bottom sill 40 of FIG. 5A includes a horizontal member 100 having a generally horizontal cross-section and a vertical member 104 having a generally vertical cross-section, which are attached to each other at a joint 103. The horizontal member 100 forms a substantially 90 degree angle with the vertical member 104 at the joint 103. However, the horizontal member 100 is bent at a small angle after the joint so that it has a gentle downward slope with respect to the horizontal plane as the horizontal member 100 is traversed away from the joint, so that the tip of the horizontal member 100 away from the joint 103 is at a lower vertical position than the joint 103. Hence, a bottom support 102 protrudes from the bottom of the bottom sill 40 between the joint and the tip, so as to provide support to the horizontal member 100 at little more than half way between the joint 103 and the tip of the horizontal member 100. Due to its sloped shape, the bottom sill 40 facilitates water drainage from the ends of the guide assembly 22 where the bottom guide 42 is shorter than the bottom sill 40.

The vertical member 104 has a segment 105 below the joint 103 so that the joint is above the level of the surface on which the bottom sill 40 is laid. A support lip 108 protrudes at the bottom of the segment 105 so as to support the bottom sill 40 when the bottom sill 40 is placed on a surface.

The bottom sill 40 has a flange 106 formed thereon, that protrudes in the same direction as the horizontal member 100. The bottom side of the flange 106 forms a substantially 90 degree angle with the vertical member 104 at a joint 107. However, the top side of the flange 106 has a generally convex shape as it is traversed from the joint to its tip.

As illustrated on FIG. 5B, the bottom guide 42 has bottom tracks 120, 116 and 112 connected together by bridges 114 and 118. The tracks 120 and 116 are connected by the bridge 114, and the tracks 116 and 112 are connected by the bridge 118. A generally convex member 110 is attached to the track 120. Each of the tracks 120, 116 and 112 are generally U-shaped, while the bridges 114 and 118 are generally horizontal. Moreover, each of the tracks and the bridges as well as the generally convex member 110 is gently sloped so that it can fit on top of the sloped horizontal member 100 of the bottom sill 40. The track 112 has a lip 121 at an end away from the bridge 118. When the bottom guide 42 is installed on the bottom sill 40, the lip 121 fits between the flange 106 and the horizontal member 100.

Figure 3A:
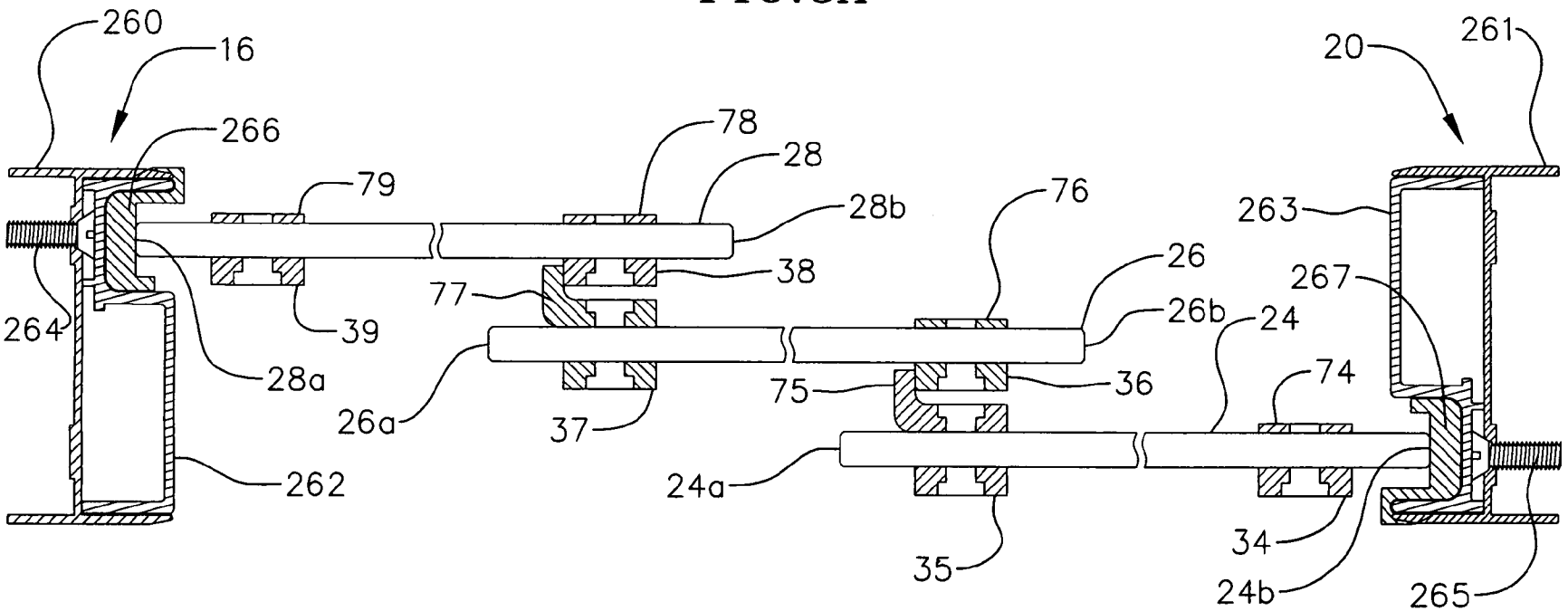
FIG. 3A is a top view of the sliding door assembly of FIG. 1, which shows bottom clips and push pull clips installed on door panels.

FIG. 3A is a top view of the sliding door assembly 10 of FIG. 1, which shows bottom clips and push pull clips installed on the door panels 24, 26 and 28, respectively. The door panel 24 has installed near its bottom the bottom clips 34 and 35. The bottom clip 34 is near the right edge 24*b* and the bottom clip 35 is near the left edge 24*a* when the shower door is viewed from outside of the enclosed shower/tub area. The other side of the bottom clip 34 is a washer 74, while the other side of the bottom clip 35 is a push pull clip 75. Similarly, the door panel 26 has installed near its bottom the bottom clips 36 and 37. The bottom clip 36 is near the right edge 26*b* and the bottom clip 37 is near the left edge 26*a* when the shower door is viewed from outside of the enclosed shower/tub area. The other side of the bottom clip 36 is a washer 76, while the other side of the bottom clip 37 is a push pull clip 77. Finally, the door panel 28 has installed near its bottom the bottom clips 38 and 39. The bottom clip 38 is near the right edge 28*b* and the bottom clip 39 is near the left edge 28*a* when the shower door is viewed from outside of the enclosed shower/tub area. The other side of the bottom clips 38 and 39 are washers 78 and 79, respectively.

Figure 3B:
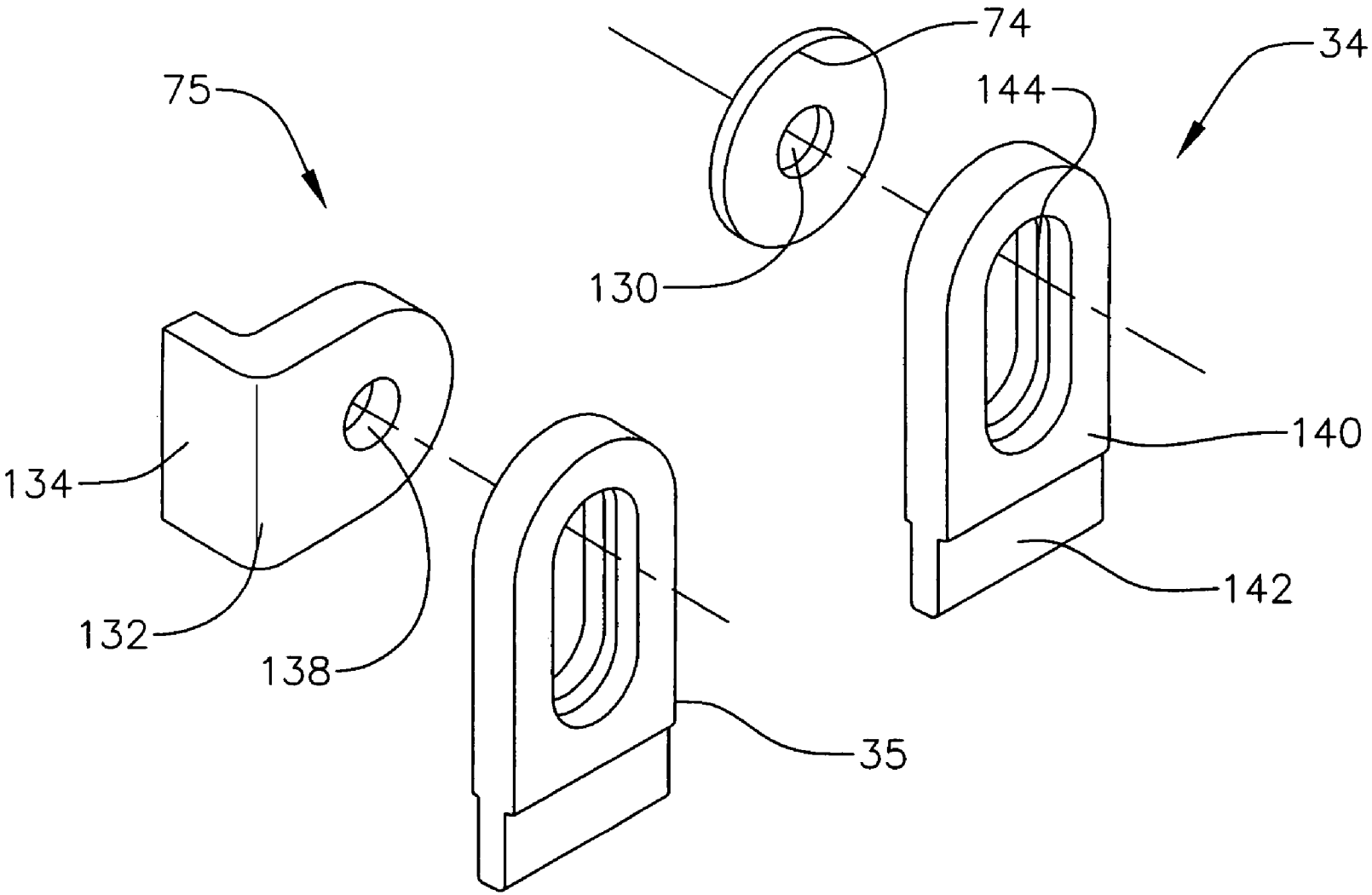
FIG. 3B is a view of bottom clips and a push clip.

FIG. 3B illustrates the bottom clips 34, 35, the push pull clip 75 and the washer 74 that are installed on the door panel 24. It can be seen that the washer 74 has a generally round shape, and has a substantially round hole 130 in the middle. The washer 74, for example, may be a flat, plastic washer. The washers 76, 78 and 79 also have the same configuration as the washer 74.

The push pull clip 75 includes two segments 134 and 136 that are connected at a joint 132, and are at a substantially 90 degree angle of each other. The shorter of the two segments (134) is substantially rectangular in shape, and is used to engage with and push and/or pull at bottom clips 36 and 37 of the door panel 26. The longer of the two segments (136) generally has a shape of a rectangle abutting a semi-circle, and has a substantially round hole 138 about the center of an imaginary circle that would have been formed by flipping the semi-circle. The substantially round hole 138 has a step within, so that the hole 138 is larger on the side of the smaller segment than the other side. In the exemplary embodiment, the push pull clip 77 has the same configuration as the push pull clip 75.

The bottom clip 34 has a substantially rectangular section 142 integrated with an elongated section 140. The elongated section 140 has an appearance of a semi-circle abutting a rectangle. The elongated section 140 is thicker than the rectangular section 142, where there is a step down from the elongated section 140 to the rectangular section 142 at both sides of the bottom clip. The rectangular section 142 of each bottom clip fits in the tracks of the guide assembly 22. The elongated section 140 has formed thereon an elongated opening 144, which has a shape of a racetrack. In the exemplary embodiment, there is a step in the elongated opening 144 so that the opening on the side of the bottom clip 34 facing the door panel 24 is smaller than the opening on the other side of bottom clip 34. Other bottom clips have the same configuration as the bottom clip 34 in the exemplary embodiment.

The washer 74 and the bottom clip 34 may be mounted on the door panel 24 using a screw or bolt that extends through the elongated opening 144 of the bottom clip 34, the door panel 24 and a hole 130 of the washer 74. The screw or bolt should enter the elongated opening 144 of the bottom clip 34 on the side where the opening is larger so that the head of the screw or the bolt can enter the larger opening, but is stopped by the smaller opening on the other side. Similarly, the bottom clip 35, and the push pull clip 75 may be mounted on the door panel 24 using a screw or bolt that extends through the elongated opening of the bottom clip 35, the panel door 24 and the hole 138 of the push pull clip 75.

The screw or bolt should enter the elongated opening of the bottom clip 34 on the side where the opening is larger. However, the screw or bolt should enter the hole 138 at the side where the opening is smaller so that, for example, a nut can be placed in the larger hole on the other end. In the exemplary embodiment, all other bottom and push pull clips and washers are installed on their respective door panels using a similar method. In other embodiments, adhesives or other fastening methods may be used to attach the bottom clips and the push pull clips to the door panels.

It can be seen in FIG. 3A that as the door panel 24 is moved to the right (e.g. so as to close the tub/shower door), the push pull clip 75 engages with and exerts force on the bottom clip 36, so as to pull it towards the same direction.

Further, when the door panel 24 is moved to the left (e.g., so as to open the tub/shower door), the push pull clip 75 engages with and exerts force on the bottom clip 37, so as to push it towards the same direction. Similarly, when the door panel 26 is moved to the right, (e.g., so as to close the tub/shower door), the push pull clip 77 engages with and exerts force on the bottom clip 38, so as to pull it towards the same direction. Further, when the door panel 26 is moved to the left (e.g., so as to open the tub/shower door), the push pull clip 77 engages with and exerts force on the bottom clip 39, so as to push it towards the same direction. This way, the tub/shower door may be opened and closed using only the towel bar 30 or the knob 151 on the door panel 24 or the knob assembly 31 on the door panel 28.

FIG. 3A also shows a top view of the wall jamb assemblies 16 and 20 of FIG. 1, which is installed, respectively, on the vertical uprights 12 and 14 between the header 18 and the tub 32. The wall jamb assembly 16 has an adjustable jamb 262 fitted inside a wall jamb 260, while the wall jamb assembly 20 has an adjustable jamb 263 fitted inside a wall jamb 261. The adjustable jambs 262 and 263 may be tilted with respect to the wall jambs 260 and 261, respectively, using screws 264 and 265, for example.

The wall jamb assembly 20, as shown in FIG. 3A, is substantially identical to the wall jamb assembly 16 except that the top view of the wall jamb assembly 20 is a 180 degree rotated image of the top view of the wall jamb assembly 16. Hence, only the wall jamb assembly 16 will be discussed below with the understanding that the wall jamb assembly 20 has a top view that is a 180 degree rotated image of the top view of the wall jamb assembly 16.

Figure 12:
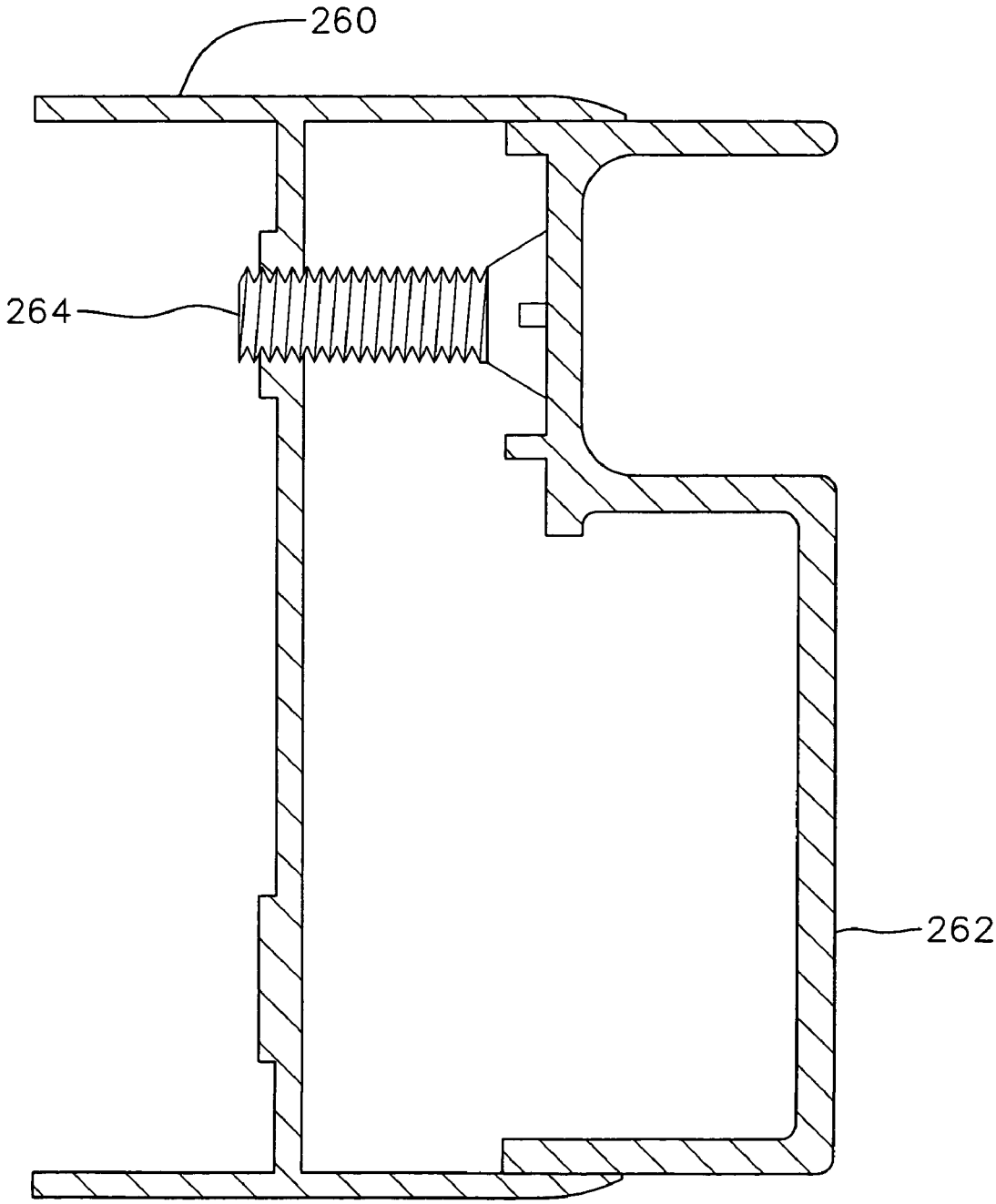
FIG. 12 is a top view of the wall jamb assembly of FIGS. 1 and 3A, in which an adjustable jamb has been tilted outwardly at the top with respect to a wall jamb.

FIG. 12 is a top view of the wall jamb assembly 16, in which the adjustable jamb 262 has been tilted outwardly at the top with respect to the wall jamb 260. Such tilting is achieved by adjusting the location of the screw head with respect to the wall jamb 260 so that the top of the adjustable jamb 262 that abuts the screw head is pushed out of the wall jamb 260. This way, the adjustable jamb 262 is tilted outwardly of the wall jamb 260. This process may be referred to as line drilling where the screw 264 between the wall jamb 260 and the adjustable jamb 262 is used to plumb the wall jamb assembly so that the adjustable jamb 262 becomes normal to the surface on which it stands.

Figure 13:
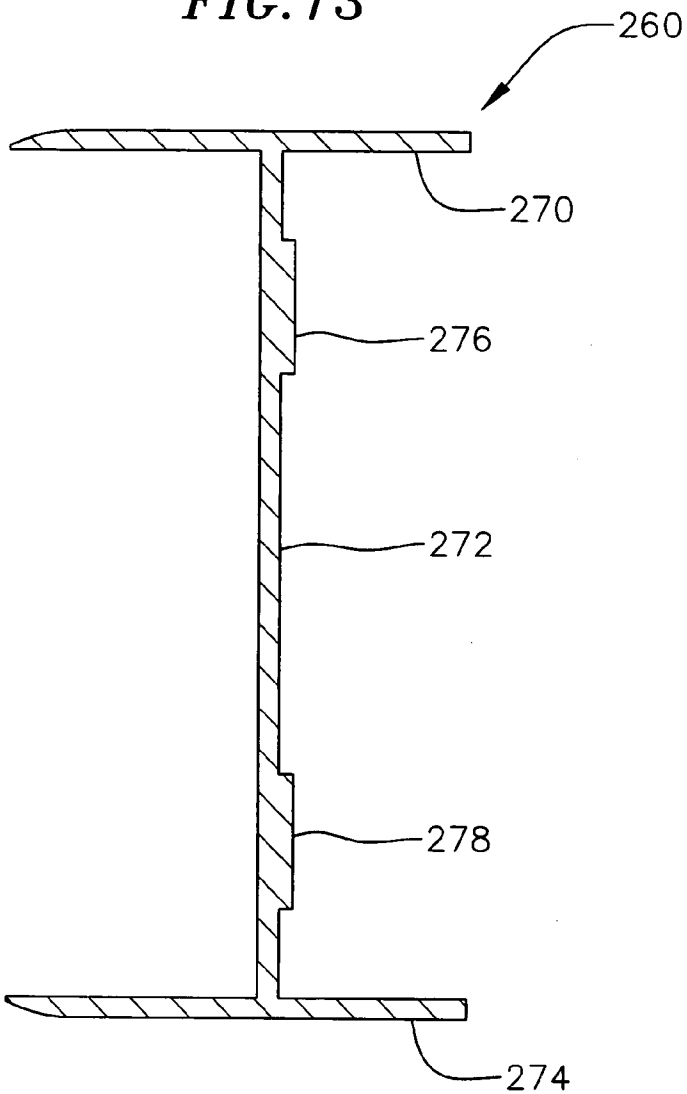
FIG. 13 is a cross-sectional view of the wall jamb of the wall jamb assembly of FIGS. 1, 3A and 12.

The wall jamb assembly 16 includes a wall jamb 260 and an adjustable wall jamb 262. As illustrated in FIG. 13, the wall jamb 260 has a cross section of "I", and includes two parallel end bars 270, 274 that have relatively short cross-sections, and a connecting bar 272 having a relatively long cross-section that connects the end bars 270 and 274 together at near their mid-points. The wall jamb 260 in the exemplary embodiment in essence has an appearance similar to that of an I-beam. The connecting bar 272 has formed thereon two bumps 276 and 278 that have a substantially rectangular cross-section.

Figure 14:
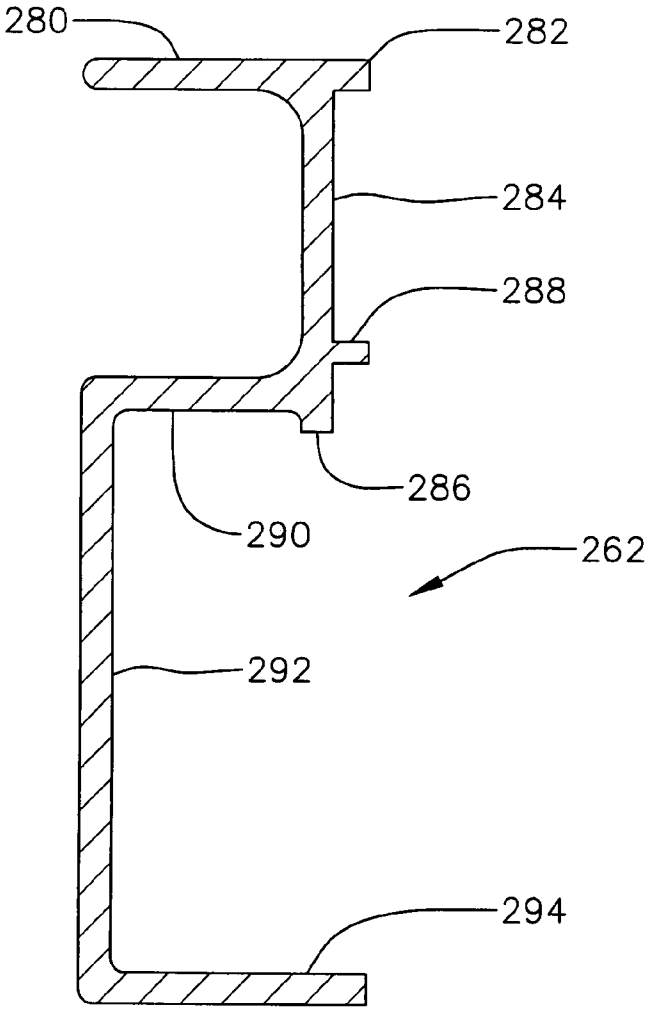
FIG. 14 is a cross-sectional view of the adjustable jamb of the wall jamb assembly of FIGS. 1, 3A and 12.

On the side away from the bumps 276 and 278 is installed the adjustable jamb 262 that has a general appearance of "S" as illustrated in FIG. 14. The adjustable jamb 262 is adjustable in a sense that it does not have to be installed parallel to the I-shaped wall jamb 260, but it can be tilted either into the wall jamb 260 or away from the wall jamb 260, so that when the wall jamb 260 is installed on the vertical upright 12 that is not normal to the floor, the adjustable jamb 262 can be tilted so as to allow the sliding door assembly to be installed normal to the floor.

The adjustable jamb 262 has three bars 280, 290 and 294 that have a cross section that are substantially parallel to one another. The adjustable jamb 262 also has a bar 284 that connects the bars 280 and 290 through their lengths near their respective edges. Further, the adjustable jamb 262 has a bar 292 that connects the bars 290 and 294 to one another through their lengths near their respective edges. The bar 284 is connected to a first end of the bar 290, and the bar 292 is connected to a second end of the bar 290. The bars are connected to each other at substantially the right angle. The bar 280 has a lip 282 that extends from the bar 284, and the bar 284 has a lip 286 that extends from the bar 290. The bar 284 also has formed thereon a lip 288 on its side away from the bar 290. As seen in FIG. 3A, the side of the adjustable jamb that has lips 282 and 288 are inserted into the wall jamb 260 to form the wall jamb assembly 16.

The adjustable wall jamb 262 also has disposed thereon a bumper 266 located between the bars 280 and 290 to provide cushion to the door panel 28 when it is closed. Similar to the wall jamb assembly 16, the wall jamb assembly 20 includes a bumper 267 that provides cushion to the door panel 24 when it is closed.

It will be appreciated by those of ordinary skill in the art that the invention can be embodied in other specific forms without departing from the spirit or essential character thereof. The present invention is therefore considered in all respects to be illustrative and not restrictive. The scope of the invention is indicated by the appended I claims, and all changes that come within the meaning and range of equivalents thereof are intended to be embraced therein.

The invention claimed is:

1. A sliding door assembly for an enclosed tub or shower, said assembly comprising:

at least three frameless panels;

a plurality of roller assemblies, wherein each frameless panel is gripped at a top by at least two roller assemblies;

a header supporting the frameless panels via the roller assemblies, wherein the roller assemblies are slidably suspended from the header; and a guide assembly having at least three tracks, wherein each frameless panel is guided by a corresponding one of the tracks.

2. The sliding door assembly of claim 1, wherein the guide assembly comprises a bottom sill and a bottom guide laid on top of the bottom sill, said bottom guide comprising said tracks, wherein the bottom guide is shorter than the bottom sill at both ends, thereby allowing water accumulated in the tracks to be drained through said both ends.

3. The sliding door assembly of claim 2, wherein the bottom guide is shorter than the bottom sill at each end by approximately 1.27 cm to approximately 2.54 cm.

4. The sliding door assembly of claim 2, wherein the bottom sill has a slope such that an inner edge of the bottom sill on a side of a tub or shower area is lower than an outer edge of the bottom sill that is adjacent to outside of the tub or shower area, so that the accumulated water flows towards the tub or shower area when drained from the tracks.

5. The sliding door assembly of claim 1, wherein the guide assembly has a plurality of openings on its side, said sliding door assembly further comprising a pluralities of plugs for plugging the openings.

6. The sliding door assembly of claim 1, wherein the header comprises a top web and at least three flanges, wherein a channel to receive said at least two roller assemblies is formed on each flange.

7. The sliding door assembly of claim 6, wherein each roller assembly comprises a roller tire and a hanger assembly, wherein the roller tire is mounted on a corresponding one of the channels, and the hanger assembly grips the frameless panel.

8. The sliding door assembly of claim 1, further comprising a push pull clip being installed at a bottom of at least one of the frameless panels, wherein the push pull clip on a first frameless panel allows a user to slide a second frameless panel by sliding the first frameless panel.

9. The sliding door assembly of claim 8, further comprising a plurality of bottom clips, each bottom clip being installed proximately to a bottom edge of a corresponding frameless panel, wherein the push pull clip on the first frameless panel engages with and exerts force on a bottom clip of the second frameless panel, thereby moving the second frameless glass panel in a same direction as the first frameless panel.

10. The sliding door assembly of claim 1, further comprising a towel bar installed on an outermost frameless panel.

11. The sliding door assembly of claim 1, further comprising a knob assembly installed on an innermost frameless panel.

12. The sliding door assembly of claim 1, wherein the frameless door panel comprises glass or acrylic.

13. The sliding door assembly of claim 1, wherein the frameless door panel comprises a clear material.

14. A shower door installed between first and second vertical uprights that define an entrance to an enclosed tub or shower, said shower door comprising:

first and second wall jamb assemblies mounted, respectively, on the first and second vertical uprights;

at least three frameless panels installed between the first and second wall jamb assemblies;

a plurality of roller assemblies, wherein each frameless panel is gripped at a top by at least two, roller assemblies;

a header supporting the frameless panels via the roller assemblies, said header extending substantially a whole length between the first and second vertical uprights, wherein the roller assemblies are slidably suspended from the header;

a guide assembly having at least three tracks and extending substantially a whole length between the first and second wall jamb assemblies, wherein each frameless panel is guided by a corresponding one of the tracks;

a plurality of bottom clips installed proximately to bottom edges of the frameless panels, said bottom clips extending below the bottom edges of the frameless panels and into the corresponding tracks; and a plurality of push pull clips, each push pull clip disposed to engage at least one bottom clip of an adjacent frameless panel during opening or closing of the shower door, thereby allowing at least two of the frameless panels to be moved together by directly exerting force on only one frameless panel.

15. The shower door of claim 14, wherein the guide assembly comprises a bottom sill and a bottom guide laid on top of the bottom sill, said bottom guide comprising said tracks, wherein the bottom guide is shorter than the bottom sill at both ends, thereby allowing water accumulated in the tracks to be drained through said both ends.

16. The sliding door assembly of claim 1, wherein the guide assembly comprises a bottom sill and a bottom guide laid on top of the bottom sill, said bottom guide comprising said tracks, wherein the bottom guide is fixed to the bottom sill.

17. A sliding door assembly for an enclosed tub or shower, said assembly comprising:

at least three panels without a metal frame around their respective peripheral edges;

a plurality of roller assemblies, each of the roller assemblies comprising a roller tire and a hanger assembly including two hangers, each of the hangers having a plurality of teeth formed thereon for gripping, wherein each of the panels is gripped at a top by the teeth of the hangers in at least two of the roller assemblies;

a header supporting the panels via the roller assemblies, wherein the roller tires of the roller assemblies are slidably suspended from the header; and a guide assembly having at least three tracks, wherein each frameless panel is guided by a corresponding one of the tracks.

18. The sliding door assembly of claim 17, wherein the guide assembly comprises an elongated bottom sill and an elongated bottom guide laid on top of the elongated bottom sill, said elongated bottom guide comprising said tracks, wherein the elongated bottom guide is elongated in a direction in which the elongated bottom sill is elongated, and is shorter than the elongated bottom sill at both ends, thereby allowing water accumulated in the tracks to be drained through said both ends.

19. The sliding door assembly of claim 18, wherein the elongated bottom sill has a slope such that an inner edge of the elongated bottom sill on a side of a tub or shower area is lower than an outer edge of the elongated bottom sill that is adjacent to outside of the tub or shower area, so that the accumulated water flows towards the tub or shower area when drained from the tracks.

* * * * *